US010689941B2

(12) United States Patent
Hazel

(10) Patent No.: US 10,689,941 B2
(45) Date of Patent: Jun. 23, 2020

(54) DOWNHOLE TUBULAR ASSEMBLY OF A WELL TUBULAR STRUCTURE

(71) Applicant: Welltec Oilfield Solutions AG, Zug (CH)

(72) Inventor: Paul Hazel, Aberdeen (GB)

(73) Assignee: Welltec Oilfield Solutions AG, Zug (CH)

( * ) Notice: Subject to any disclaimer, the term of this patent is extended or adjusted under 35 U.S.C. 154(b) by 108 days.

(21) Appl. No.: 15/567,477

(22) PCT Filed: Apr. 29, 2016

(86) PCT No.: PCT/EP2016/059601
§ 371 (c)(1),
(2) Date: Oct. 18, 2017

(87) PCT Pub. No.: WO2016/174198
PCT Pub. Date: Nov. 3, 2016

(65) Prior Publication Data

US 2018/0106124 A1 Apr. 19, 2018

(30) Foreign Application Priority Data

Apr. 29, 2015 (EP) ..... 15165785

(51) Int. Cl.
*E21B 33/127* (2006.01)
*E21B 43/10* (2006.01)
*E21B 29/00* (2006.01)

(52) U.S. Cl.
CPC ..... *E21B 33/127* (2013.01); *E21B 29/00* (2013.01); *E21B 43/10* (2013.01)

(58) Field of Classification Search
CPC ..... E21B 29/00; E21B 33/127; E21B 43/10
See application file for complete search history.

(56) References Cited

U.S. PATENT DOCUMENTS 4,083,408 A * 4/1978 Milam ..... E21B 33/12 166/115
4,601,343 A * 7/1986 Lindsey, Jr. ..... E21B 17/06 166/242.6

(Continued)

OTHER PUBLICATIONS

International Search Report for PCT/EP2016/059601, dated Jun. 28, 2016, 3 pages.

(Continued)

*Primary Examiner* — Caroline N Butcher
(74) *Attorney, Agent, or Firm* — Nixon & Vanderhye P.C.

(57) ABSTRACT

A downhole tubular assembly configured to be mounted as part of a well tubular structure in a borehole of a well having a top, has a well metal tubing configured to be mounted as part of the well tubular structure. A tubular metal receptacle has an inner receptacle diameter larger than the outer diameter of the well metal tubing, and a second part extending from the first part towards the well metal tubing. The tubing length is larger than the receptacle length, and the a wall of the well metal tubing extends inside the tubular metal receptacle along the entire length of the tubular metal receptacle, and the second part of the tubular metal receptacle is fastened to the outer face of the well metal tubing, thereby closing the tubular metal receptacle in one end and defining an annular space between the tubular metal receptacle and the well metal tubing.

16 Claims, 10 Drawing Sheets

(56) References Cited

U.S. PATENT DOCUMENTS

| | | | | |
|---|---|---|---|---|
| 4,942,925 | A * | 7/1990 | Themig | E21B 17/06 166/382 |
| 5,743,335 | A | 4/1998 | Bussear | |
| 6,286,595 | B1 * | 9/2001 | Oxnevad | E21B 17/028 166/242.7 |
| 7,753,113 | B1 * | 7/2010 | Penisson | E21B 27/00 166/162 |
| 9,500,057 | B2 * | 11/2016 | Al-Rabeh | E21B 33/10 |
| 2003/0047321 | A1 | 3/2003 | Coon | |
| 2004/0216877 | A1 | 11/2004 | Pedersen et al. | |
| 2013/0186615 | A1 * | 7/2013 | Hallunbaek | E21B 33/127 166/120 |
| 2015/0075772 | A1 * | 3/2015 | Saponja | E21B 23/00 166/115 |
| 2016/0281459 | A1 * | 9/2016 | Stautzenberger | E21B 33/04 |

OTHER PUBLICATIONS

Written Opinion of the ISA for PCT/EP2016/059601, dated Jun. 28, 2016, 6 pages.
Extended Search Report for EP15165785.5, dated Oct. 13, 2015, 5 pages.

* cited by examiner

DOWNHOLE TUBULAR ASSEMBLY OF A WELL TUBULAR STRUCTURE

This application is the U.S. national phase of International Application No. PCT/EP2016/059601 filed 29 Apr. 2016, which designated the U.S. and claims priority to EP Patent Application No. 15165785.5 filed 29 Apr. 2015, the entire contents of each of which are hereby incorporated by reference.

FIELD OF THE INVENTION

The present invention relates to a downhole tubular assembly configured to be mounted as part of a well tubular structure in a borehole of a well having a top. Furthermore, the invention relates to a well tubular structure for being arranged in a borehole in a well and to a downhole system configured to be arranged in a borehole of a well. Finally, the invention relates to a structure replacement method for replacing at least part of the well tubular structure of a downhole system.

BACKGROUND ART

Oil and gas wells are completed in many different ways and have a variety of different designs. Some wells have cemented inner casings and some wells have uncemented inner casings. Cemented casings are completed after cementing the intermediate casing A and the lower part of the well is drilled so that the inner casing B can be submerged into the well, as shown in FIG. 1A. The cement is then led down the inner casing and out into the annulus C. In the event that, after the borehole has been drilled, tests show that the hydrostatic pressure in the annulus is too high for the cement to rise sufficiently in the annulus, the upper part of the inner casing is removed and replaced by a drill pipe, as shown in FIG. 1B. When replacing the upper part of the inner casing with a drill pipe, the annular space D between the intermediate casing and the inner casing is increased, thereby decreasing the hydrostatic pressure, which allows for the cement to be pressured up to the predetermined level shown in FIG. 1B.

In order to be able to replace the upper inner casing with a drill pipe, the inner casing has a receptacle R into which sealing elements of the upper inner casing can be fit to create a good sealed connection after the drill pipe has been retracted. However, these sealed connections tend to deteriorate over time even though they have never been used, and thus, such wells may leak over time.

SUMMARY OF THE INVENTION

It is an object of the present invention to wholly or partly overcome the above disadvantages and drawbacks of the prior art. More specifically, it is an object to provide an improved well tubular structure decreasing the risk of leaks occurring without limiting the possibility of increasing the annular space between the intermediate casing and the inner casing.

The above objects, together with numerous other objects, advantages and features, which will become evident from the below description, are accomplished by a solution in accordance with the present invention by a downhole tubular assembly configured to be mounted as part of a well tubular structure in a borehole of a well having a top, the downhole tubular assembly comprising:

a well metal tubing configured to be mounted as part of the well tubular structure, the well metal tubing having a longitudinal extension, a tubing length along the longitudinal extension, an inner diameter and an outer diameter defining a wall, an inner face and an outer face, and a tubular metal receptacle having an inner receptacle face and an outer receptacle face, a receptacle length and a first part closest to the top of the well, and having an inner receptacle diameter larger than the outer diameter of the well metal tubing, and having a second part extending from the first part towards the well metal tubing, wherein the tubing length is larger than the receptacle length, and the wall of the well metal tubing extends inside the tubular metal receptacle along the entire length of the tubular metal receptacle, and the second part of the tubular metal receptacle is fastened to the outer face of the well metal tubing, thereby closing the tubular metal receptacle in one end and defining an annular space between the tubular metal receptacle and the well metal tubing.

The second part may incline from the first part towards the well metal tubing.

Also, the tubular metal receptacle may surround the well metal tubing.

Moreover, the annular space may be at least filled with a fluid for preventing deterioration of the inner receptacle face of the tubular metal receptacle.

The fluid may be grease or silicone.

Furthermore, the fluid may be an inert gas or a noble gas.

In addition, the inner receptacle face of the tubular metal receptacle may be at least partly polished.

Also, the inner receptacle face of the tubular metal receptacle may be at least partly provided with a thread.

Moreover, the second part of the tubular metal receptacle may be fastened by welding or a threaded connection or by crimping to the outer face of the well metal tubing.

Furthermore, the tubular metal receptacle may comprise a sealing element for sealing off the annular space.

Further, the sealing element may be a closure closing the annular space.

Moreover, the inner face of the well metal tubing may have a cutting indication, such as a circumferential recess or a circumferential projection configured to indicate where the well metal tubing is to be cut.

The well metal tubing may be cut e.g. at a predetermined distance from the cutting indication.

Also, the cutting indication may be arranged opposite the tubular metal receptacle.

Moreover, the sealing element may comprise an elastomeric material, a metal, a polymer, rubber or any combination thereof.

In addition, the tubular assembly may comprise a circumferential recess having an inner recess diameter larger than the inner diameter of the well metal tubing, the recess being configured to receive a projecting element of a tool string and being arranged at a predetermined distance from the second part of the tubular metal receptacle.

Moreover, an identification tag may be arranged at the tubular metal receptacle for identifying the position of the tubular metal receptacle, especially the second part of the tubular metal receptacle.

The downhole tubular assembly described above may further comprise an annular barrier comprising:

a tubular metal part for mounting as part of a well tubular structure, an expandable metal sleeve surrounding the tubular metal part and having an inner face facing the tubular metal part and an outer face, each end of the expandable metal sleeve being connected with the tubular metal part, and an annular space between the inner face of the expandable metal sleeve and the tubular metal part.

The present invention furthermore relates to a well tubular structure made of metal for being arranged in a borehole in a well, comprising a plurality of tubular sections, at least one of the tubular sections being the downhole tubular assembly as described above.

Moreover, at least one of the tubular sections may comprise an annular barrier comprising:

a tubular metal part for mounting as part of the well tubular structure, an expandable metal sleeve surrounding the tubular metal part and having an inner face facing the tubular metal part and an outer face, each end of the expandable metal sleeve being connected with the tubular metal part, and an annular space between the inner face of the expandable metal sleeve and the tubular metal part.

Furthermore, at least one of the tubular sections may comprise a circumferential recess.

The circumferential recess may be arranged at a predetermined distance from the second part of the tubular metal receptacle.

The present invention furthermore relates to a downhole system configured to be arranged in a borehole of a well, comprising:

a well tubular structure as described above, an intermediate tubular metal structure, the well tubular structure being at least partly arranged in the intermediate tubular metal structure, and at least one main annular barrier arranged between the well tubular structure and the intermediate tubular metal structure, defining an annulus above the main annular barrier.

Also, the downhole system may comprise a tool string comprising a tubing cutting tool.

Furthermore, the tool string may further comprise a docking unit having a projecting element being configured to engage with the circumferential recess.

The tubing cutting tool and the projecting element may have a mutual tool distance between them, the tool distance and the predetermined distance between the circumferential recess and the second part of the tubular metal receptacle being substantially equal.

Furthermore, the tool string may comprise a logging unit configured to detect an identification tag.

Finally, the present invention relates to a structure replacement method for replacing at least part of the well tubular structure as described above of a downhole system as described above, comprising the steps of:

submerging a tool string having the tubing cutting tool into the well tubular structure, positioning the tubing cutting tool opposite the tubular metal receptacle, cutting the well metal tubing above the position where the second part is fastened to the well metal tubing, retracting the tool string from the well tubular structure, retracting the well tubular structure above the cut to expose the tubular metal receptacle, inserting a new and/or second well tubular structure in the borehole, inserting an end of the new and/or second well tubular structure in the tubular metal receptacle, and landing the new and/or second well tubular structure in the exposed tubular metal receptacle to sealingly connect the new and/or second well tubular structure to the tubular metal receptacle.

Moreover, the step of positioning the tubing cutting tool may be performed by engaging a projecting element in the circumferential recess, the tubing cutting tool and the projecting element having a mutual tool distance between them, the tool distance and the predetermined distance between the circumferential recess and the second part of the tubular metal receptacle being substantially equal.

Furthermore, the step of positioning the tubing cutting tool may be performed by a logging tool identifying an identification tag arranged at the tubular metal receptacle.

Moreover, sealing elements may be arranged on an outside face of the new and/or second well tubular structure, which outside face is arranged opposite the inner receptacle face of the tubular metal receptacle to provide a sealing between the tubular metal receptacle and the new and/or second well tubular structure.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
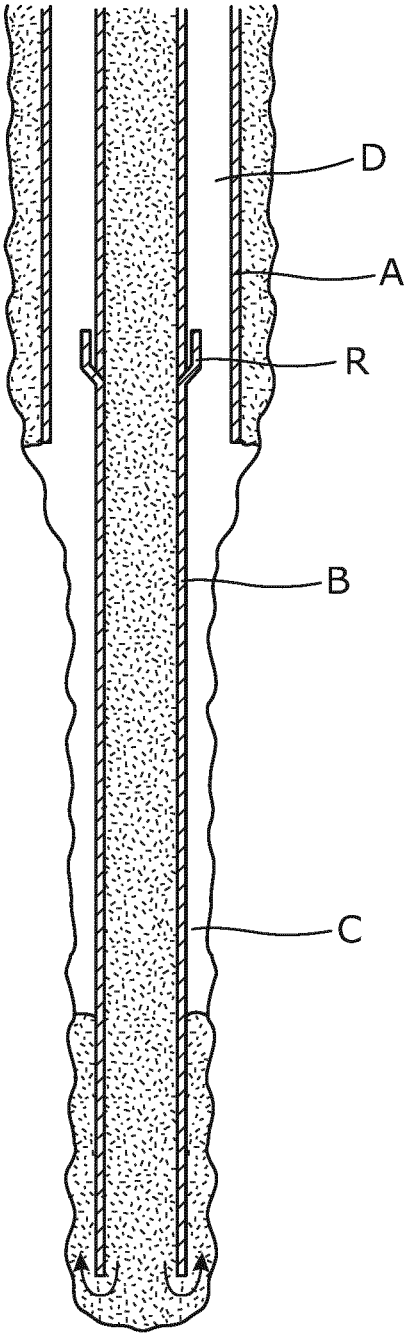
Fig. 1A (Prior Art)
FIGS. 1A and 1B show a prior art well completion.
Figure 1B:
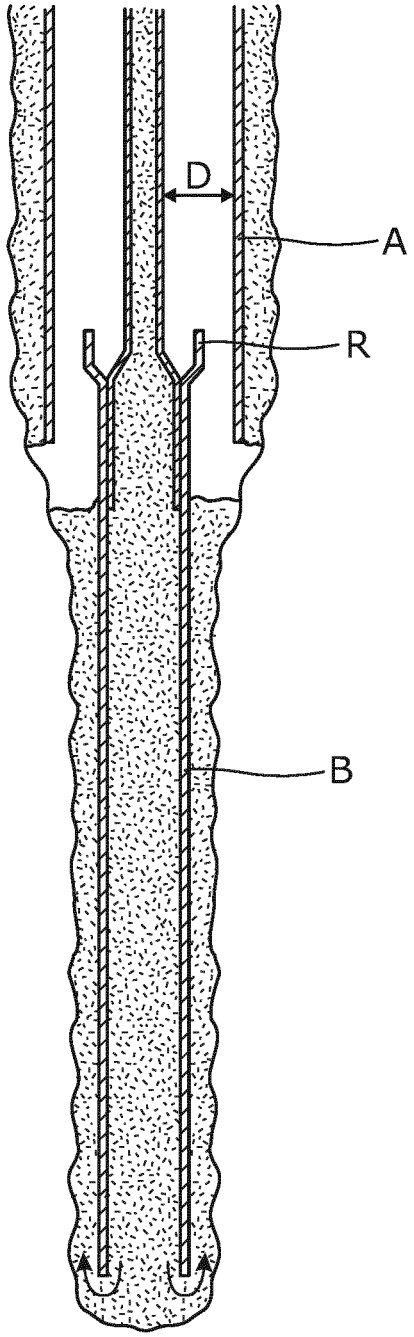
Fig. 1B (Prior Art)
Figure 2:
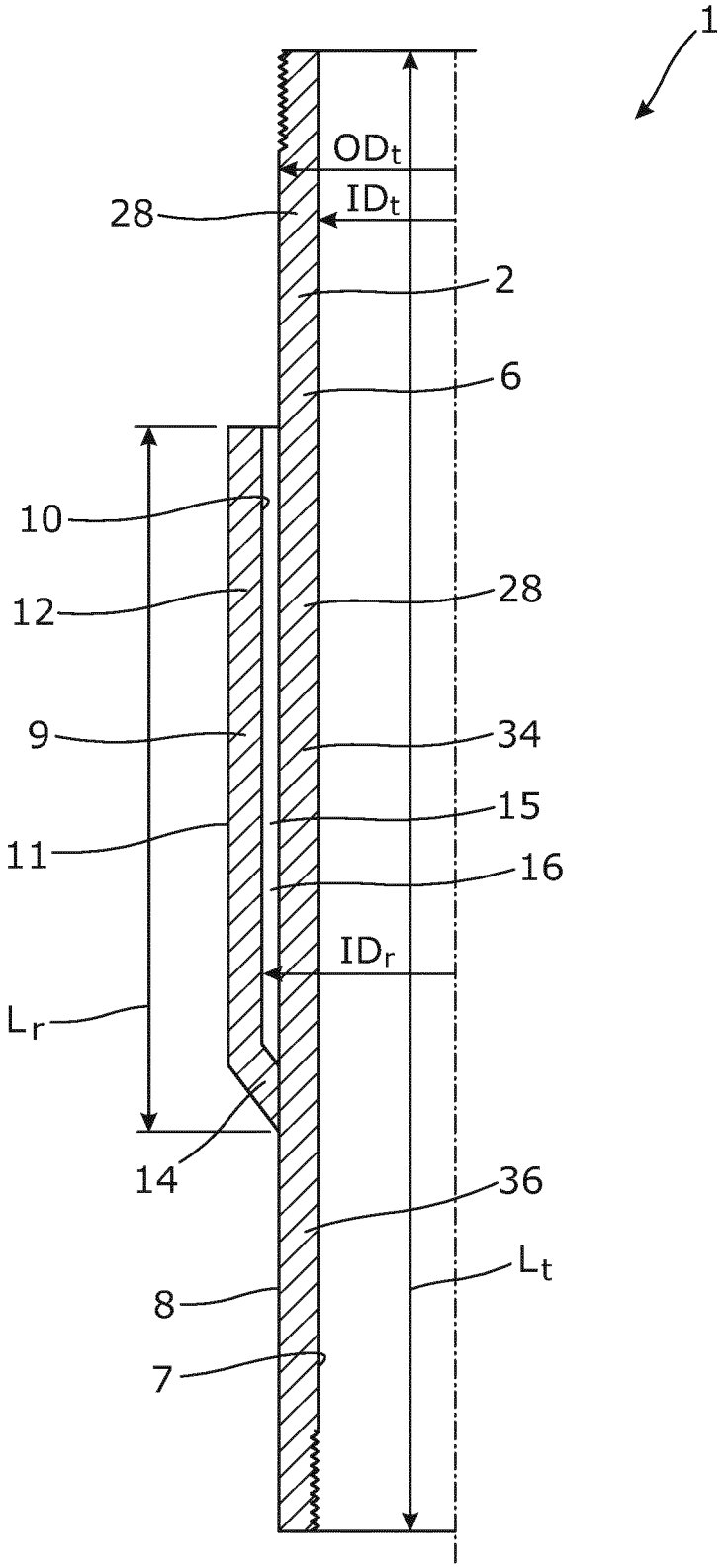
FIG. 2 shows a cross-sectional view of a downhole tubular assembly having a metal receptacle.
Figure 3:
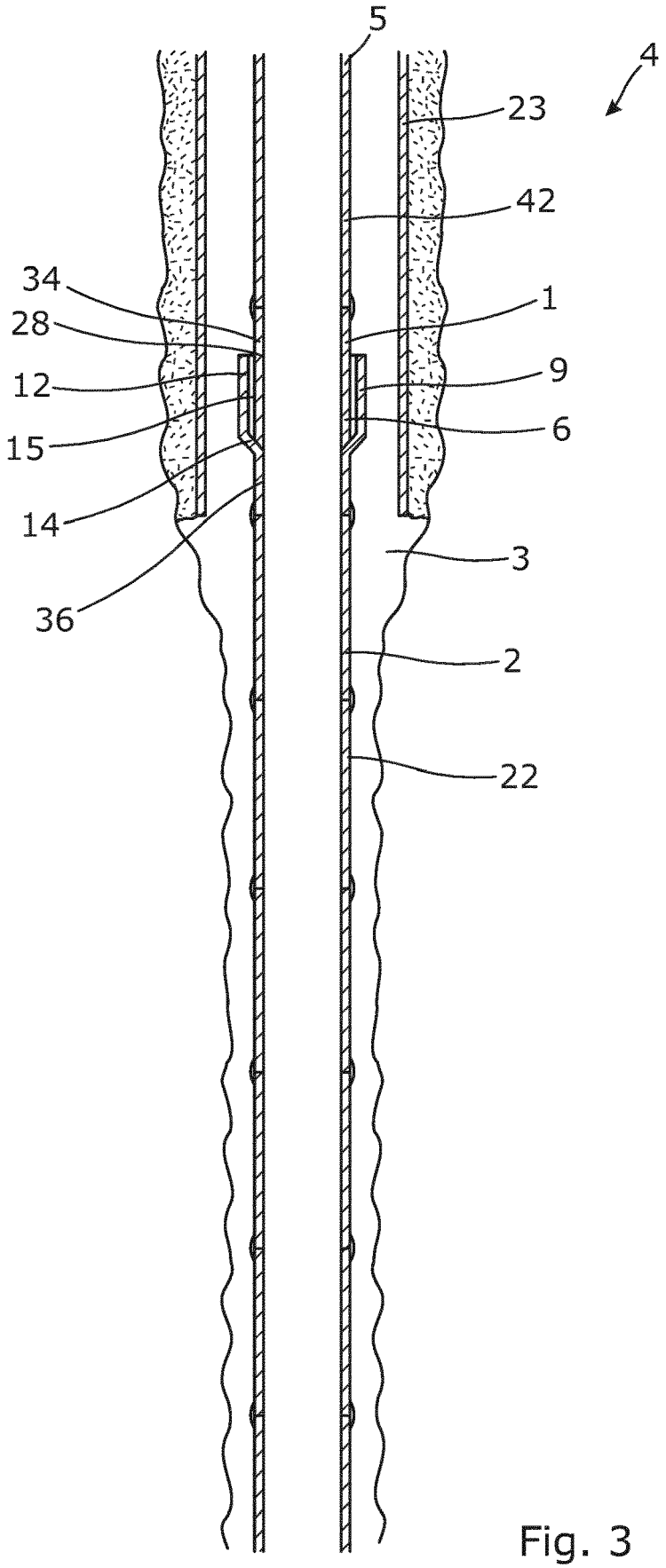
FIG. 3 shows a cross-sectional view of a well tubular structure having a metal receptacle.

FIG. 2 shows a downhole tubular assembly 1 configured to be mounted as part of a well tubular structure 2 in a borehole 3 of a well 4 having a top 5, as shown in FIG. 3. The downhole tubular assembly 1 comprises a well metal tubing 6 configured to be mounted as part of the well tubular structure 2 and a tubular metal receptacle 9 arranged on an outside of the well metal tubing and circumferenting the well metal tubing so that the well metal tubing extends inside the tubular metal receptacle 9 along an entire length of the tubular metal receptacle.

The downhole tubular assembly 1 of FIG. 2 has a tubing length $L_t$ along a longitudinal extension of the well metal tubing 6, an inner face 7 and an outer face 8, and an inner diameter $ID_t$ and an outer diameter $OD_t$ defining a wall 28 therebetween. The tubular metal receptacle 9 has an inner receptacle face 10 and an outer receptacle face 11, a receptacle length $L_r$, which is smaller than the tubing length $L_t$, and a first part 12 closest to the top of the well. The tubular metal receptacle 9 has an inner receptacle diameter $ID_r$ larger than the outer diameter of the well tubing part, and a second part 14 of the tubular metal receptacle 9 extends from the first part 12 towards the well metal tubing 6 in an inclining manner. Thus, the wall 28 of the well metal tubing 6 extends inside the tubular metal receptacle 9 along the entire length of the tubular metal receptacle, and the second part 14 of the tubular metal receptacle 9 is fastened to the outer face 8 of the well metal tubing 6, thereby closing the tubular metal receptacle in one end furthest away from the top of the well and defining an annular space 15 between the inner receptacle face 10 of the tubular metal receptacle 9 and the outer face 8 of the well metal tubing 6.

Figure 4:
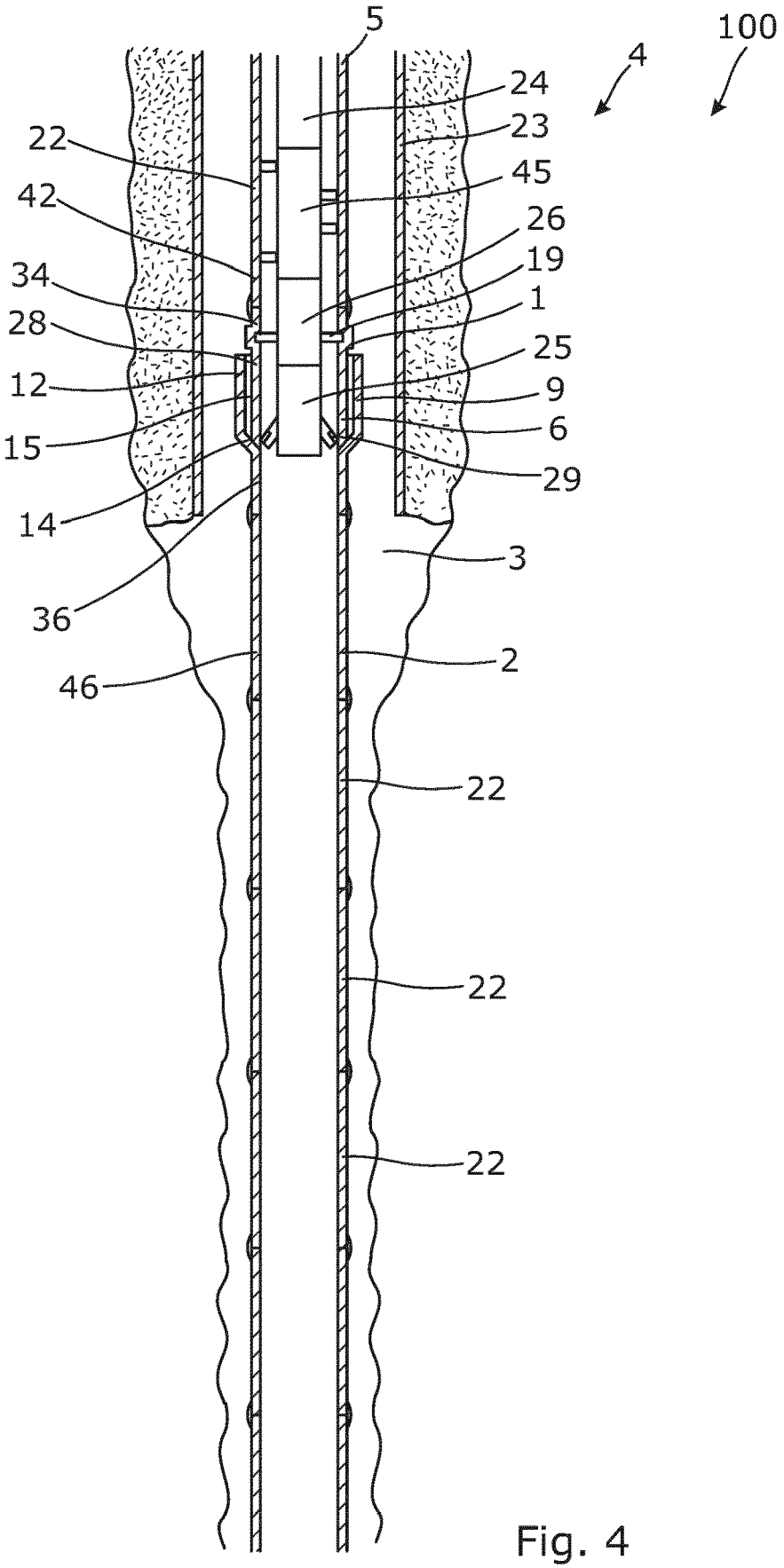
FIG. 4 shows a cross-sectional view of downhole system having a tubing cutting tool.

The well metal tubing 6 is thus intact and uninterrupted opposite the metal receptacle 9, and when the well metal tubing is mounted as part of the well tubular structure 2, there is no sealing risk as there is no interrupted well tubing parts opposite the metal receptacle 9 as in the known solutions. In the event that calculations and tests show that the upper section of the well tubular structure above the metal receptacle 9 needs to be replaced with a drill pipe, a tool string 24 comprising a tubing cutting tool 25 is submerged into the well tubular structure 2 so that a projectable cutting part 29 is arranged opposite the metal receptacle 9 and cuts a first section 34 of the well metal tubing 6 from a second section 36 of the well metal tubing 6, as shown in FIG. 4. By having the metal receptacle 9 on the outside of the well metal tubing 6, the well tubular structure 2 is prepared to replace an upper part 42 with a drill pipe by a simple cut if needed. However, if the tests and calculations show that there is no need for inserting a drill pipe to perform the cement job, the well metal tubing 6 and the well tubular structure 2 are kept intact, and the risk of leaks in the receptacle connections is avoided. The casing collars necessary for mounting the well tubular structure 2 from the tubular sections 22 is still unavoidable, but these very firmly sealed connections do not have the same risk of causing leaks.

As shown in FIG. 4, the tool string 24 also comprises an anchoring section 45 for providing a backing during the machining operation when the tubing cutting tool 25 cuts and separates the first section 34 of the well metal tubing 6 from a second section 36 of the well metal tubing 6, thus separating the upper part 42 of the well tubular structure from a lower part 46.

The inner receptacle face 10 of the tubular metal receptacle 9 is polished at least along the first part 12. The annular space 15 of FIG. 2 may be at least partly filled with a fluid 16 for preventing deterioration of the inner receptacle face 10 of the tubular metal receptacle 9 to prevent the inner receptacle face from deteriorating significantly. In this way, the receptacle 9 is ready for use at any time during the life time of the well. The fluid 16 may be grease or silicone filling up the annular space 15.

Figure 5:
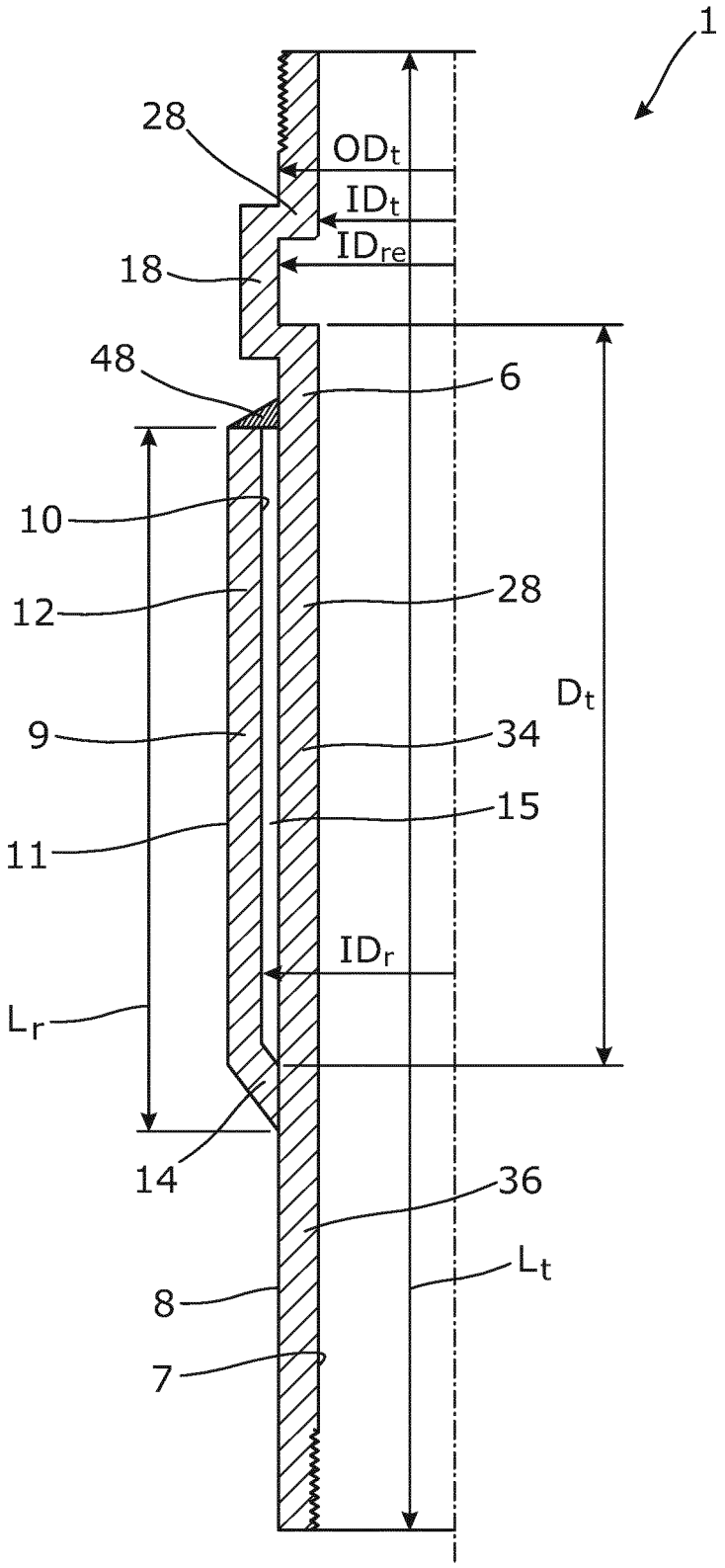
FIG. 5 shows a cross-sectional view of another downhole tubular assembly having a recess at a distance from the receptacle.
Figure 6:
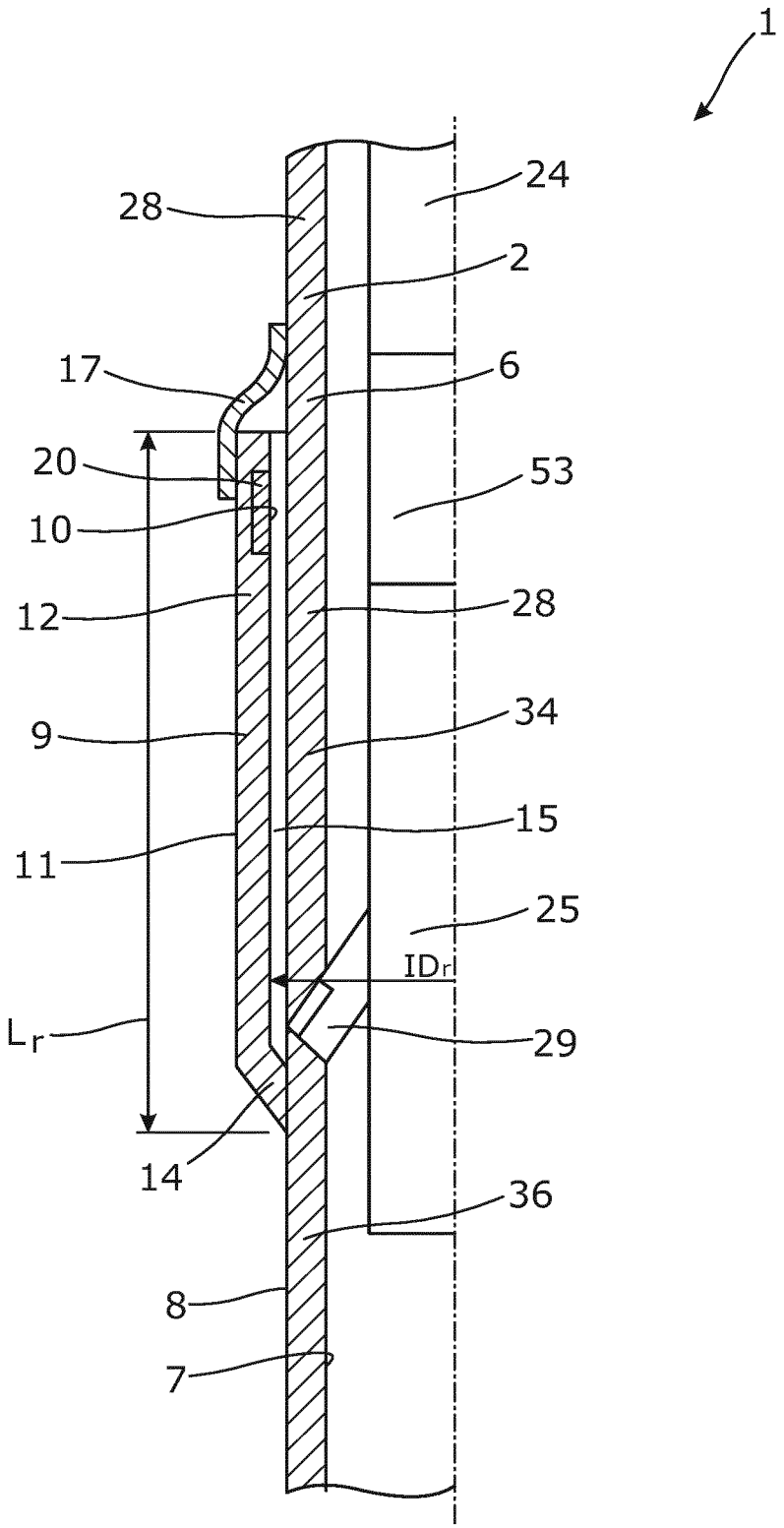
FIG. 6 shows a cross-sectional view of another downhole tubular assembly.

In FIG. 2, the tubular metal receptacle 9 is open at its top, and since the tubular metal receptacle is often used within a few months from insertion in the borehole, the polished inner receptacle face is normally not deteriorated significantly. However, when the annular space 15 is filled with grease or silicone, the polished inner receptacle face 10 is still maintained in a non-corroded condition and is thus ready for use years after completion of the well. The annular space 15 may also be fully closed in that the second part 14 of the tubular metal receptacle 9 is fastened by welding 48, as shown in FIG. 5, by a threaded connection or by crimping to the outer face 8 of the well metal tubing 6. The annular space 15 may also by be sealed off by a sealing element 17, as shown in FIG. 6. The annular space 15 may, even when fully closed, also be filled with a fluid, such as the grease or silicone mentioned above or an inert gas or a noble gas. The sealing element 17 comprises an elastomeric material, a metal, a polymer, a rubber or any combination thereof.

In FIG. 5, the tubular assembly 1 further comprises a circumferential recess 18 having an inner recess diameter $ID_{re}$ larger than the inner diameter of the well metal tubing 6. The recess is configured to receive a projecting element 19 of a docking unit 26 of the downhole tool string 24 as shown in FIG. 4. The recess 18 of FIG. 5 is thus arranged at a predetermined distance $D_t$ from the second part 14 of the tubular metal receptacle 9 so that when cutting the well metal tubing 6, the cut is positioned correctly.

Another way of identifying the position of the tubular metal receptacle 9, especially the second part 14 of the tubular metal receptacle, and thus identifying where to cut, is to identify an identification tag 20 arranged in the tubular metal receptacle 9, as shown in FIG. 6. The downhole tool string 24 may thus comprise a logging unit 53 for identifying the identification tag 20, as shown in FIG. 6. The logging unit may also be a magnetic profiling or an ultrasonic tool capable of identifying the tubular metal receptacle.

Figure 7:
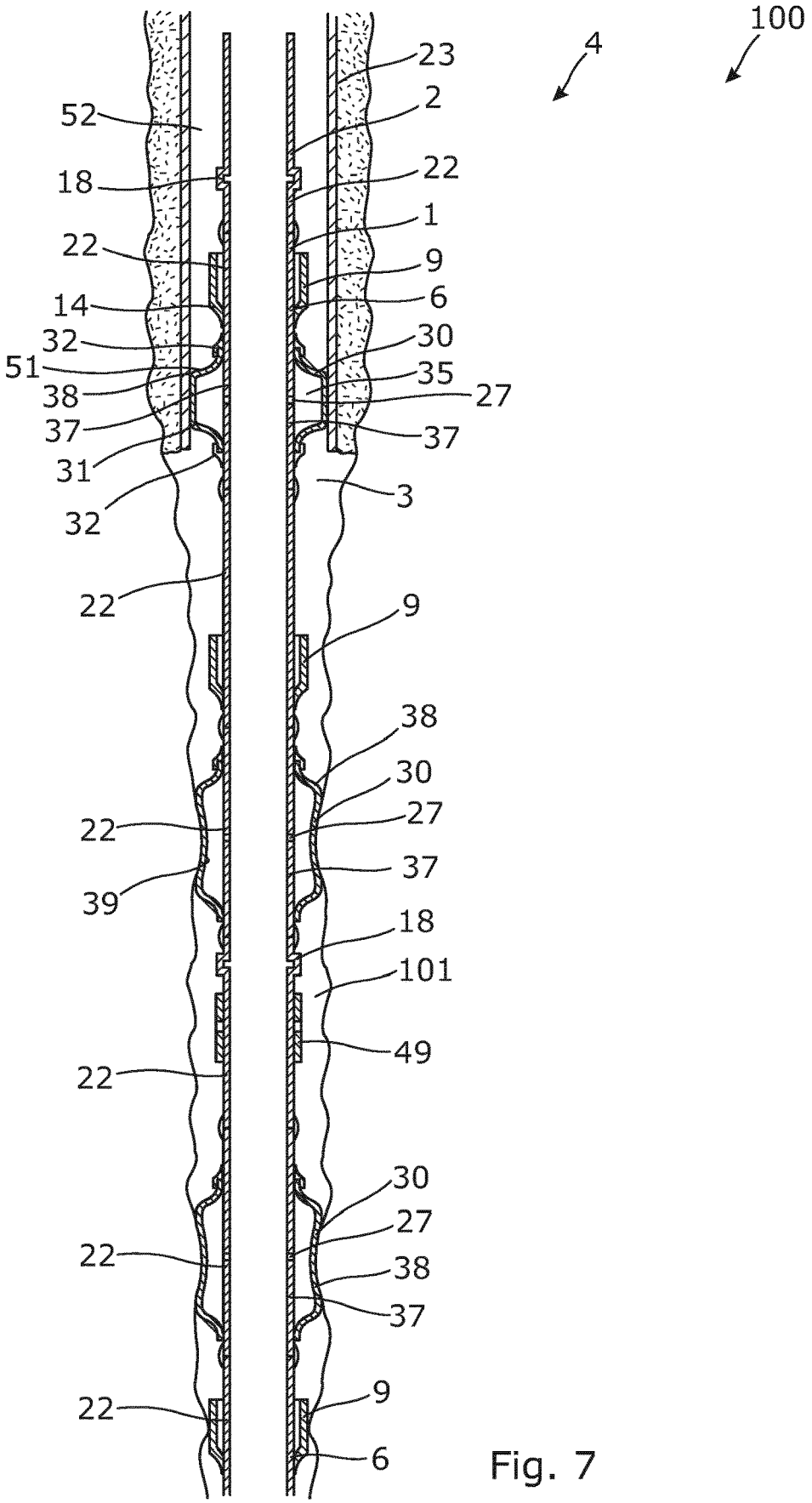
FIG. 7 shows a cross-sectional view of another downhole system having annular barriers.

As shown in FIG. 7, the downhole tubular assembly 1 further comprises an annular barrier 30 comprising a tubular metal part 37 being the well metal tubing 6 for mounting as part of the well tubular structure 2. The annular barrier 30 comprises an expandable metal sleeve 38 surrounding the tubular metal part and having an inner face 39 facing the tubular metal part 37 and an outer face 31 facing the borehole 3. Each end 32 of the expandable metal sleeve 38 is connected with the tubular metal part 37, defining an annular space 35 between the inner face of the expandable metal sleeve and the tubular metal part. The tubular metal part 37 comprises an expansion opening 27 opposite the annular space 35 so as to allow pressurised fluid inside the tubular metal part 37 to enter the annular space and expand the expandable metal sleeve 38.

As shown in FIG. 7, the well tubular structure 2 arranged in the borehole 3 in the well 4 comprises a plurality of tubular sections 22, where at least one of the tubular sections is the downhole tubular assembly 1 comprising the metal receptacle 9. The well tubular structure 2 comprises two other annular barriers 30 isolating a production zone 101, and one of the tubular sections 22 opposite the production zone 101 comprises an inflow control device 49 for allowing well fluid to flow into the well tubular structure 2. A tubular section 22 of the well tubular structure 2 above the metal receptacle 9 comprises a circumferential recess 18 which is arranged at a predetermined distance $D_t$ (shown in FIG. 5) from the receptacle 9 so that the tubing cutting tool is positioned in such a way that it cuts correctly just above the second part 14 of the receptacle 9. The well tubular structure 2 further comprises tubular sections 22 comprising a metal receptacle 9, meaning that metal receptacles 9 are arranged further down the well. In this way, lower parts of the well tubular structure 2 can be replaced with new and/or second tubular sections 22 or tubular sections 22 comprising e.g. an annular barrier or an inflow control device. By having metal receptacles 9 arranged further down the well, parts of the well tubular structure 2 arranged above such receptacles can be pulled out of the well and replaced with a new and/or second tubular structure, and thus, corroded parts of the well tubular structure can be replaced without having to pull out the entire well tubular structure 2.

As shown in FIG. 7, a new improved downhole system 100 configured to be arranged in a borehole of a well has been provided, comprising the well tubular structure 2 and an intermediate tubular metal structure 23, where the well tubular structure 2 is arranged inside the intermediate tubular metal structure 23 and lowered further down the well. Between the well tubular structure 2 and the intermediate tubular metal structure 23 a main annular barrier 51 is arranged, defining an annulus 52 above the main annular barrier. The main annular barrier 51 is thus an annular barrier as described above.

The downhole system 100 of FIG. 7 has another recess 18 arranged at a predetermined distance from a completion component, e.g. the inflow control device 49, so that the projecting elements of the docking unit of the downhole tool string 24 shown in FIG. 4 can be projected and in a biasing manner abut the inner face of the well tubular structure 2. As the tool string 24 approaches the circumferential recess, the projecting elements project further into the recess and thus dock into the recess, thereby positioning the tool in the correct distance from the component, and the tool can thus operate e.g. a sliding sleeve, the inflow control device, etc.

Figure 8:
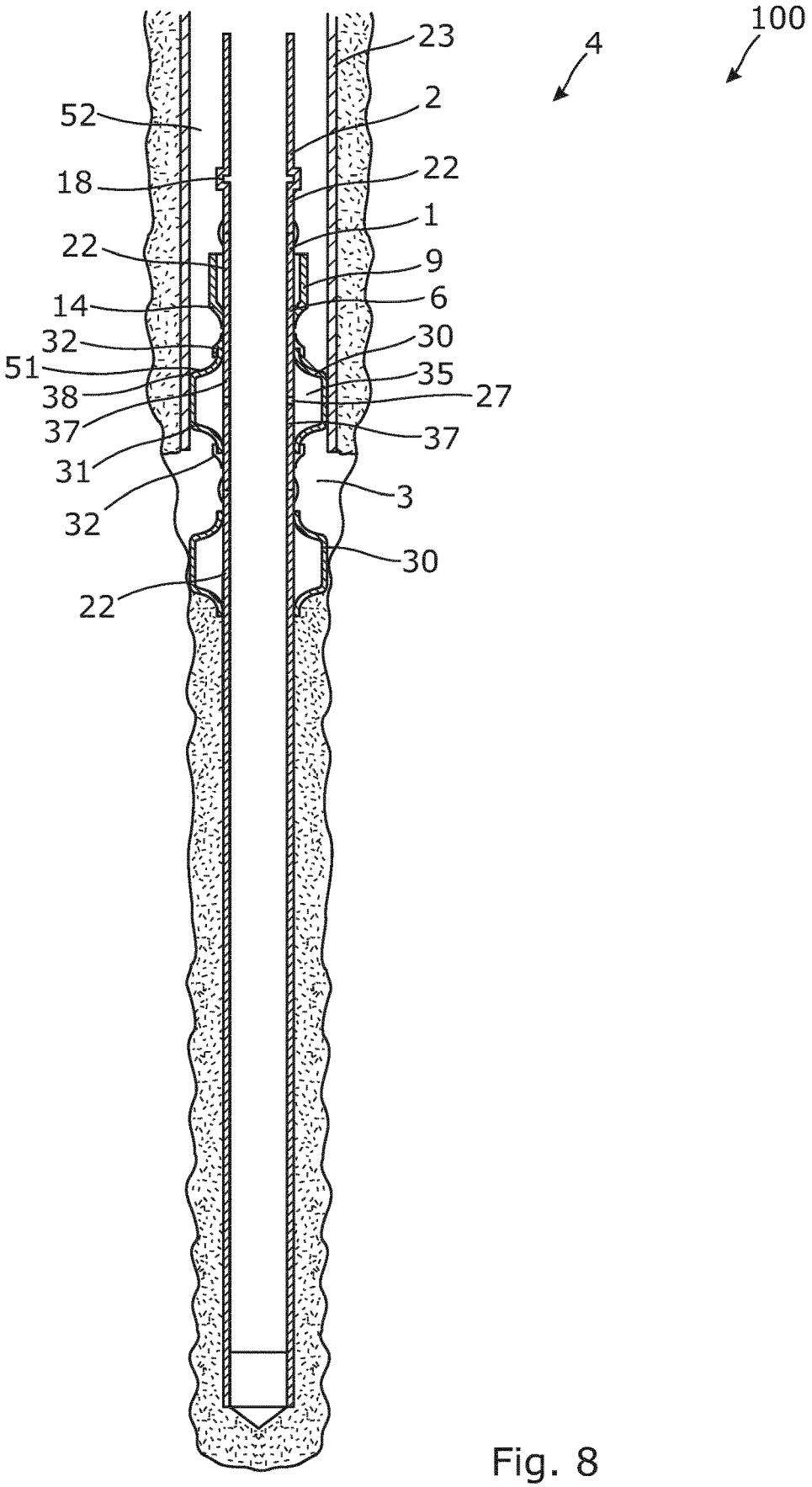
FIG. 8 shows a cross-sectional view of another downhole system having annular barriers.

In FIG. 8, the well tubular structure 2 has a second annular barrier arranged below the main annular barrier 51. The well is thus cemented all the way up to the level of the second annular barrier, and subsequently, the second annular barrier is expanded. Thus, the main annular barrier provides a primary barrier of the A annulus and the second annular barrier provides a secondary barrier of the B annulus.

Figure 9:
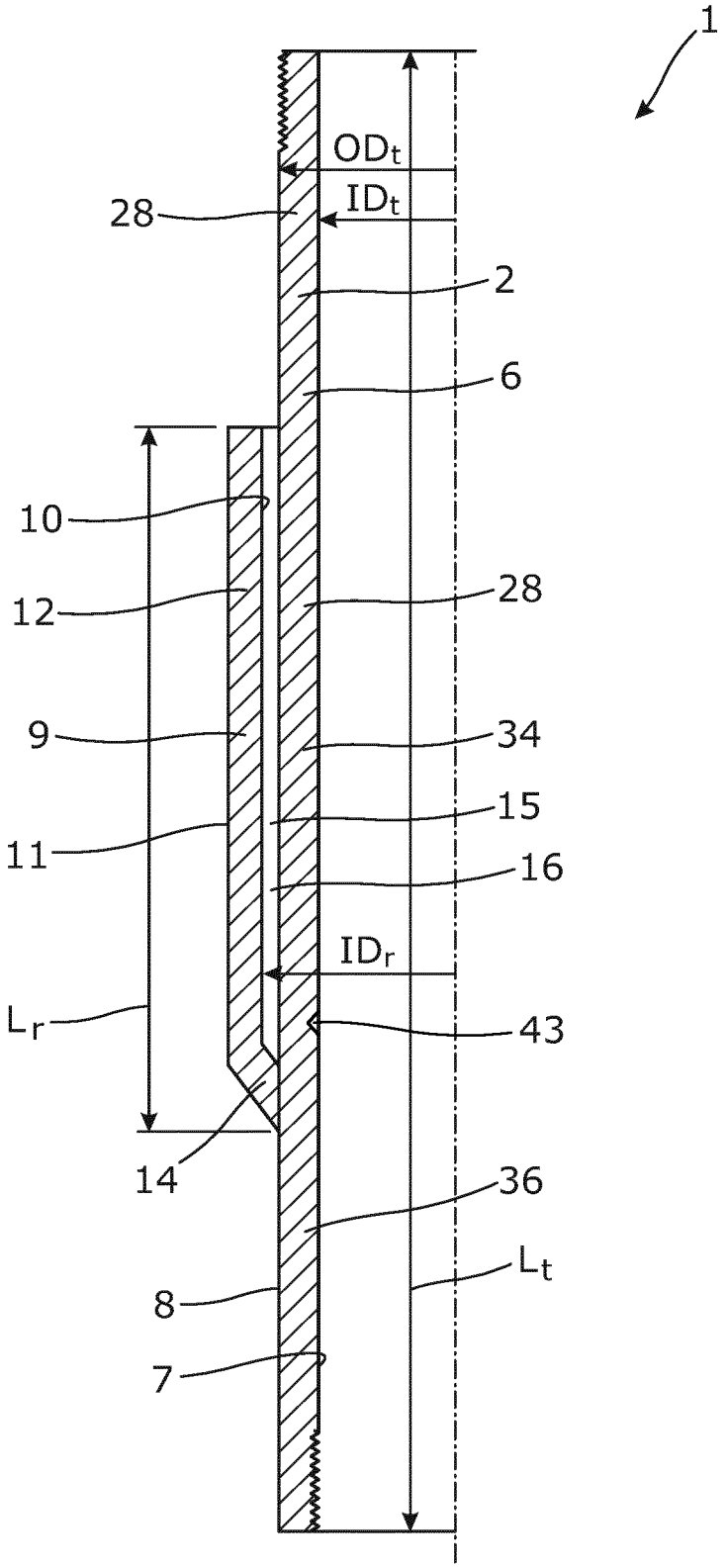
FIG. 9 shows a cross-sectional view of another downhole tubular assembly having a metal receptacle.

In FIG. 9, the downhole tubular assembly 1 has a metal receptacle 9 and a cutting indication 43 in the well metal tubing 6. The cutting indication 43 is arranged opposite the annular space 15 between the tubular metal receptacle 9 and the well metal tubing 6 and indicates where the well metal tubing 6 is to be cut in order to expose the inner face 10 of the tubular metal receptacle.

The inner face of the tubular metal receptacle is exposed so that a second well metal tubing abutting the inner face can be arranged and sealed against the inner face of the tubular metal receptacle 9. A second well metal tubing may be used to replace a worn out part of the previous well metal tubing or the second well metal tubing may have a smaller inner diameter which promotes the production of hydrocarbons. Thus, the second well metal tubing may have an outer diameter which is larger than the outer diameter $OD_t$ of the cut well metal tubing 6, so that the outer face of the second well metal tubing contact the inner face 10 of the tubular metal receptacle. The cutting indication may also be arranged at a distance to the area which is most suitable to cut in. By having a cutting indication, the projectable cutting part 29 (shown in FIG. 6) of the tubing cutting tool may slide along the inner face 7 of the well metal tubing 6, and once engaging the cutting indication, the tubing cutting tool stops moving along the longitudinal extension and the cutting operation is initiated. The cutting indication may be a circumferential recess or a circumferential projection.

By well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or a well tubular structure is meant any kind of pipe, tubing, tubular, liner, string etc. used downhole in relation to oil or natural gas production. The well tubular structure is made of metal and mounted from tubular sections.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole tubular assembly configured to be mounted as part of a well tubular structure in a borehole of a well having a top, the downhole tubular assembly comprising:

a well metal tubing configured to be mounted as part of the well tubular structure, the well metal tubing having a longitudinal extension, a tubing length along the longitudinal extension, an inner diameter and an outer diameter defining a wall, an inner face and an outer face, and a tubular metal receptacle having an inner receptacle face and an outer receptacle face, a receptacle length and a first part closest to the top of the well, and having an inner receptacle diameter larger than the outer diameter of the well metal tubing, and having a second part extending from the first part towards the well metal tubing, wherein the well metal tubing length is larger than the tubular metal receptacle length, and the wall of the well metal tubing extends inside the tubular metal receptacle along the entire length of the tubular metal receptacle, and the second part of the tubular metal receptacle is fastened to the outer face of the well metal tubing at a location positioned on the outer face of the well metal tubing, thereby closing the tubular metal receptacle in one end and defining an annular space between the tubular metal receptacle and the well metal tubing, and wherein the annular space is at least partly filled with a fluid for preventing deterioration of the inner receptacle face of the tubular metal receptacle, wherein the downhole tubular assembly further comprising an annular barrier comprising:

a tubular metal part for mounting as part of a well tubular structure, an expandable metal sleeve surrounding the tubular metal part and having an inner face facing the tubular metal part and an outer face, each end of the expandable metal sleeve being connected with the tubular metal part, and a further annular space between the inner face of the expandable metal sleeve and the tubular metal part, and wherein the well metal tubing and the tubular metal receptacle are non-movably fixed to one another.

2. The downhole tubular assembly according to claim 1, wherein the tubular metal receptacle surrounds the well metal tubing.

3. The downhole tubular assembly according to claim 1, wherein the inner receptacle face of the tubular metal receptacle is at least partly polished.

4. The downhole tubular assembly according to claim 1, wherein the tubular metal receptacle comprises a sealing element for sealing off the annular space.

5. The well tubular structure for being arranged in the borehole in the well, comprising a plurality of tubular sections, at least one of the tubular sections being the downhole tubular assembly according to claim 1.

6. The well tubular structure according to claim 5, wherein at least one of the tubular sections comprises an annular barrier comprising:

a tubular metal part for mounting as part of the well tubular structure, an expandable metal sleeve surrounding the tubular metal part and having an inner face facing the tubular metal part and an outer face, each end of the expandable metal sleeve being connected with the tubular metal part, and a further annular space between the inner face of the expandable metal sleeve and the tubular metal part.

7. The well tubular structure according to claim 5, wherein at least one of the tubular sections comprises a circumferential recess.

8. The well tubular structure according to claim 7, wherein the circumferential recess is arranged at a predetermined distance from the second part of the tubular metal receptacle.

9. A downhole system configured to be arranged in the borehole of the well, comprising:

the well tubular structure according to claim 5, an intermediate tubular metal structure, the well tubular structure being at least partly arranged in the intermediate tubular metal structure, and at least one main annular barrier arranged between the well tubular structure and the intermediate tubular metal structure, defining an annulus above the main annular barrier.

10. The downhole system according to claim 9, wherein the downhole system comprises a tool string comprising a tubing cutting tool.

11. The downhole system according to claim 10, wherein the tool string further comprises a docking unit having a projecting element being configured to engage with the circumferential recess.

12. The downhole system according to claim 11, wherein the tubing cutting tool and the projecting element have a mutual tool distance between them, the tool distance and the predetermined distance between the circumferential recess and the second part of the tubular metal receptacle being substantially equal.

13. A structure replacement method for replacing at least part of the well tubular structure according to claim 5 of a downhole system, comprising:

submerging a tool string having a tubing cutting tool into the well tubular structure, positioning the tubing cutting tool opposite the tubular metal receptacle, cutting the well metal tubing above the position where the second part is fastened to the well metal tubing, retracting the tool string from the well tubular structure, retracting the well tubular structure above the cut to expose the tubular metal receptacle, inserting a second well tubular structure in the borehole, inserting an end of the second well tubular structure in the tubular metal receptacle, and landing the second well tubular structure in the exposed tubular metal receptacle to sealingly connect the second well tubular structure to the tubular metal receptacle.

14. The downhole tubular assembly according to claim 1, wherein the inner diameter of the well metal tubing does not include a seal.

15. A downhole tubular assembly configured to be mounted as part of a well tubular structure in a borehole of a well having a top, the downhole tubular assembly comprising:

a well metal tubing configured to be mounted as part of the well tubular structure, the well metal tubing having a longitudinal extension, a tubing length along the longitudinal extension, an inner diameter and an outer diameter defining a wall, an inner face and an outer face, and a tubular metal receptacle having an inner receptacle face and an outer receptacle face, a receptacle length and a first part closest to the top of the well, and having an inner receptacle diameter larger than the outer diameter of the well metal tubing, and having a second part extending from the first part towards the well metal tubing, wherein the well metal tubing length is larger than the tubular metal receptacle length, and the wall of the well metal tubing extends inside the tubular metal receptacle along the entire length of the tubular metal receptacle, and the second part of the tubular metal receptacle is fastened to the outer face of the well metal tubing at a location positioned on the outer face of the well metal tubing, thereby closing the tubular metal receptacle in one end and defining an annular space between the tubular metal receptacle and the well metal tubing, and wherein the annular space is at least partly filled with a fluid for preventing deterioration of the inner receptacle face of the tubular metal receptacle, wherein the downhole tubular assembly further comprising an annular barrier comprising:

a tubular metal part for mounting as part of a well tubular structure, an expandable metal sleeve surrounding the tubular metal part and having an inner face facing the tubular metal part and an outer face, each end of the expandable metal sleeve being connected with the tubular metal part, and a further annular space between the inner face of the expandable metal sleeve and the tubular metal part, wherein the second part of the tubular metal receptacle is fastened by welding or a threaded connection or by crimping to the outer face of the well metal tubing.

16. A downhole tubular assembly configured to be mounted as part of a well tubular structure in a borehole of a well having a top, the downhole tubular assembly comprising:

a well metal tubing configured to be mounted as part of the well tubular structure, the well metal tubing having a longitudinal extension, a tubing length along the longitudinal extension, an inner diameter and an outer diameter defining a wall, an inner face and an outer face, and a tubular metal receptacle having an inner receptacle face and an outer receptacle face, a receptacle length and a first part closest to the top of the well, and having an inner receptacle diameter larger than the outer diameter of the well metal tubing, and having a second part extending from the first part towards the well metal tubing, wherein the well metal tubing length is larger than the tubular metal receptacle length, and the wall of the well metal tubing extends inside the tubular metal receptacle along the entire length of the tubular metal receptacle, and the second part of the tubular metal receptacle is fastened to the outer face of the well metal tubing at a location positioned on the outer face of the well metal tubing, thereby closing the tubular metal receptacle in one end and defining an annular space between the tubular metal receptacle and the well metal tubing, and wherein the annular space is at least partly filled with a fluid for preventing deterioration of the inner receptacle face of the tubular metal receptacle, wherein the downhole tubular assembly further comprising an annular barrier comprising:

a tubular metal part for mounting as part of a well tubular structure, an expandable metal sleeve surrounding the tubular metal part and having an inner face facing the tubular metal part and an outer face, each end of the expandable metal sleeve being connected with the tubular metal part, and a further annular space between the inner face of the expandable metal sleeve and the tubular metal part, wherein the well metal tubing comprises a one piece construction having first and second ends, the receptacle being fasted fastened to the outer face of the well metal tubing at a location positioned on the outer face and between the first and second ends.

* * * * *